US008595879B2

(12) United States Patent
Capolupo

(10) Patent No.: US 8,595,879 B2
(45) Date of Patent: Dec. 3, 2013

(54) BRIDGE BEAM PLACEMENT SYSTEM AND APPARATUS

(71) Applicant: SPS New England, Inc., Salisbury, MA (US)

(72) Inventor: Wayne P. Capolupo, Salisbury, MA (US)

(73) Assignee: SPS New England, Inc., Salisbury, MA (US)

( * ) Notice: Subject to any disclaimer, the term of this patent is extended or adjusted under 35 U.S.C. 154(b) by 0 days.

(21) Appl. No.: 13/644,385

(22) Filed: Oct. 4, 2012

(65) Prior Publication Data

US 2013/0081215 A1 Apr. 4, 2013

Related U.S. Application Data

(60) Provisional application No. 61/543,060, filed on Oct. 4, 2011.

(51) Int. Cl.
*E01D 21/06* (2006.01)

(52) U.S. Cl.
USPC ..... 14/77.1; 14/74.5; 414/10

(58) Field of Classification Search
USPC ..... 14/73.5, 74.5, 75, 77.1–78; 414/10
See application file for complete search history.

(56) References Cited

U.S. PATENT DOCUMENTS

| | | | | | |
|---|---|---|---|---|---|
| 3,003,219 | A * | 10/1961 | Suter et al. | ..... | 264/33 |
| 3,456,826 | A * | 7/1969 | Pavlik | ..... | 414/498 |
| 3,563,180 | A * | 2/1971 | Rutledge | ..... | 104/288 |
| 3,902,212 | A * | 9/1975 | Muller | ..... | 14/77.1 |
| 4,282,978 | A * | 8/1981 | Zambon | ..... | 212/312 |
| 4,497,153 | A * | 2/1985 | Muller | ..... | 14/77.1 |
| 5,511,268 | A * | 4/1996 | Albus et al. | ..... | 14/77.1 |
| 5,960,502 | A * | 10/1999 | Sherman et al. | ..... | 14/77.1 |
| 6,721,985 | B2 * | 4/2004 | McCrary | ..... | 14/77.1 |
| 7,520,014 | B2 * | 4/2009 | Homsi | ..... | 14/77.1 |
| 8,166,596 | B2 * | 5/2012 | Kang et al. | ..... | 14/77.1 |

* cited by examiner

*Primary Examiner* — Raymond W Addie
(74) *Attorney, Agent, or Firm* — Sonia K. Guterman; Michael I. Falkoff; Preeti Tanksale

(57) ABSTRACT

Beam placement during bridge construction by a carriage moving across an abutment or pier, supporting the end of a beam or pipe to position and align it on the abutment. A lift assembly lowers the end and the carriage is disengaged and moved to receive another beam, placing multiple parallel beams, without requiring a large crane. A carriage formed in sections separates to return to a new position. A screw jack or hydraulic unit moves the lift assembly, and deposits the beam on a load plate, and opposed separately-operated lift plates connected by a hinged cross-bar may form a beam-receiving basket assembly. Carriage rollers bear against a channel iron that protects underlying concrete structure from damage. A first set of rollers may bear against a horizontal surface and a second set of rollers bear against a vertical face of the abutment, aligning the carriage and beam along orthogonal axes.

20 Claims, 4 Drawing Sheets

BRIDGE BEAM PLACEMENT SYSTEM AND APPARATUS

RELATED APPLICATIONS

This application is related to and claims the benefit of the U.S. Provisional Application Ser. No. 61/543,060 filed Oct. 4, 2011.

The present invention relates to methods and equipment for roadway and bridge construction, to an apparatus for placing or positioning beams and structural elements of a bridge, and to improved utilization of equipment resources to simplify project execution and coordination with relevant traffic and utilities, to promote efficiency and to expedite bridge and roadway construction.

BACKGROUND

Modern span bridges are designed and engineered to carry heavy loads across a span extending between two sides, above an underlying feature such as a railway bed, another roadway, a river or stream, a chasm or a landscape feature such as a depression, elevation or cityscape. A typical highway bridge having a road bed for trucks, cars and other heavy vehicles, is built of one or more spans, each span extending between two massive supporting structures, such as piers or abutments. A span is formed by laying a plurality of beams, such as so-called steel I-beams, tub girders or reinforced concrete beams across the supporting structures, with the beams extending generally parallel to the road direction. Cross bracing may be employed to stabilize the beams in position. A roadway surface, such as a reinforced concrete slab surface, is then built or formed on top of the supporting beams.

The bridge beams used in each span may be large and difficult to move or maneuver. For example a beam formed of steel may be less than thirty to more than one hundred feet long, and may weigh hundreds of pounds per linear foot, with a total weight of tens of tons. Reinforced concrete beams of comparable stiffness and load bearing capacity may also be dimensionally large and of even greater weight.

Bridge construction involves site preparation and casting of concrete foundations forming abutments and piers at suitably-spaced and positioned locations, followed by positioning of the necessary bridge beams on the piers, followed by construction of the road surface. Each bridge beam must be accurately positioned across a span, onto seats or load plates on opposed abutments or piers to precisely position and define the support plane upon which the road bed is built. Moving the beams into proper positions on the support foundations is usually accomplished by attaching a beam via one or more cables to a tall heavy-load crane; extending the crane and moving the crane and/or the crane boom so that the beam lies approximately above two spaced-apart support foundations; and lowering the cable/sling while carefully guiding the ends of the beam into position on the supports. The beam size necessitates a crane having a great load capacity, especially in an extended position, in order to lift the beam over, and lower the beam down upon, the foundations or piers with the beam ends accurately positioned and aligned. Moreover, the crane boom should be quite long so that when extended to an appropriate position halfway across the span, it will lie at a steep angle and thus experience a relative low torque moment from the vertically-directed weight of the heavy beam, and thus will not tip or otherwise destabilize the crane vehicle. For example, an eighty foot or longer crane, capable of lifting thirty tons or more when extended, may be required to place even a relatively short but heavy beam.

Moving a large crane to a construction site along public roadways may require special permits, may require that the crane be disassembled and accompanied by one or more safety or escort vehicles carrying cautionary signs or lights, and may require coordination with special traffic management personnel. Care must also be taken to assure that width and weight capacity of all roads and bridges along the access route are adequate to support the crane and accommodate its spatial dimensions with clearance. The logistics for deployment of the crane can introduce substantial costs and delay into a bridge construction schedule.

In addition, larger cranes require a highly skilled operator to assure smooth and accurate operation, and they are quite specialized equipment, requiring advance scheduling. In addition, unexpected characteristics of the surrounding terrain may pose further problems for suitably stabilizing the crane vehicle on the site. All of these necessary logistic considerations and potential complications can introduce undesirable cost and delay into the construction of a bridge.

If a bridge could be constructed to the same spec without having to use a large crane for initially positioning the bridge beams, substantial efficiencies of construction and scheduling, with concomitant cost savings, could be realized and a greater degree of certainty brought to project management.

SUMMARY OF INVENTION

The present invention provides such benefits by providing a specialized rig and system for building a bridge, wherein bridge beams are placed upon supporting foundations without requiring a large crane. A pair of carriages placed on each foundation travels horizontally to position and align the end of a bridge beam in position on a seat on the top of the foundation, which is, e.g., an abutment or pier. The beam has a longitudinal axis, and the carriage rolls along the top of the abutment or pier carrying the beam to the desired position. The carriage is configured and adapted to move in a direction transverse to the longitudinal axis of the beam, and carries, or is saddled with, a lift basket assembly that removably receives and carries an end of the beam. The lift basket is vertically movable so that when the end of the beam is held in the basket and movement of the carriage has brought the beam to the desired position, the basket may be lowered to simply and precisely deposit the beam in position upon the seat. Both ends of the beam may be simultaneously moved into position by a carriage assembly on the respective abutments or piers, and after the beam is lowered into a final position each basket may be disengaged from the beam end and the carriage then moved back across the abutment or pier to receive another beam. The carriage may be constructed with a centrally-located channel, cleft or mid-space into which the beam may be placed, so the carriage effectively straddles the end of the beam. Once the basket assembly has been disengaged the carriage may, for example, slide transversely under the beam to return to its point of origin on the foundation to receive another beam. Two or more beams are thus moved into positions parallel with each other and spanning the intended width of the roadway. Advantageously, the carriage system allows simple controlled movement and positioning of beams thus obviating the need for a large crane customarily used in beam placement. Smaller load-handling rigs and equipment readily available or already present at the construction site may be used to load the beam (e.g., from a truck/trailer bed) onto the carriage/lift basket assembly. In one embodiment, the beam may be rolled in an axial direction into the channel of the carriage, after which the carriage is rolled horizontally across the pier to position the beam end.

Each carriage in the pair may include, or may move on load-bearing rollers, such as Hilman® roller assemblies or skates, which may, for example be fabricated together with plates or other structural elements forming the body of the carriage. Preferably, before the carriage is placed atop the cement foundation backwall, a track, such as a length of U-shaped channel iron, is affixed to each of one or more flat surfaces along the top of the pier or abutment on which the carriage rollers ride, to precisely define a load-bearing roller/carriage path for linear lateral or transverse movement of the carriage as it positions and aligns the end of the beam on the pier. The track or channel, which also protects the concrete structure from being damaged by the carriage rollers, may be removably fastened to the flat surface with a few pins or bolts, allowing it to be removed after the carriage has done its job.

The carriage roller assemblies are positioned, in relation to the carriage frame, to achieve a stable, non-tipping carriage vehicle. The frame is formed of strong structural material, such as heavy steel plates or lengths of beams, to form a body or frame that defines a cleft or slot between two sides into which the beam is fitted; the body or frame further defines load-bearing planes of the roller assemblies. In one embodiment the carriage may include a first set of rollers located to bear against a load-bearing horizontal surface of the cement foundation structure and a second set of rollers located to bear against a vertical face of the foundation structure; the two sets of rollers thereby define two fixed planes and operating to maintain a non-tipping alignment of the carriage, hence of the beam, along two axes as the carriage moves. In another embodiment suitable for use on a foundation structure such as a broad flat pier, several sets of rollers may all be positioned underneath the carriage to roll on a single flat horizontal surface or horizontally-disposed set of steel channel-tracks. The carriage may have a central slot in which the lift basket rides such that beam weight bears vertically downward on a central region of the carriage, rather than at an edge thereof, so there is no tipping or imbalance. In both constructions, vertical movement of the lift basket provides control of the third axis of movement for lowering the beam into its intended position after traversing the surface of the pier or abutment. Rather than linear rails or channel iron strips under the roller assemblies, steel plates may be affixed to the surface(s) of the concrete pier or abutment facing the rollers to protect against damage without constraining the roller path followed by the roller assemblies.

Vertical movement of the lift basket is provided by a jack assembly, such as a screw jack (operated, e.g., by a hand crank), an hydraulic cylinder jack, or a cam-type jack. The jack assembly is actuated to raise or lower the beam. The lift basket may be a generally cradle-like structure carried by the carriage, or may, for example, be constituted by two opposed separately-operated lift plates connected by a hinged cross-bar or otherwise configured to form a cradle or other structure (such as a pair of opposed jaws) capable of holding and lifting or supporting the end of the beam above the pier surface.

Once a beam is deposited in position on an abutment or pier, the lift basket is disengaged from the beam and the carriage is re-positioned to receive and carry a further beam into a parallel position, until all the beams have been placed. In this manner all the beams are positioned by simple carriage assemblies, one at each end of the beam, riding on top of the respective supporting abutments or piers, and the carriages are then removed. The carriage may include a means for adjusting offset of one or more sets of rollers along one or more axes for carrying out slight dimensional adjustments of the carriage (hence beam) orientation or position. In this manner, movements of the carriage and lift basket accurately maintain and achieve accurate beam positioning in all three axes.

A method according to the invention for positioning a beam for a bridge onto a pair of supporting structures such as abutments or piers, comprises the steps of positioning each of a pair of carriage assemblies on a respective abutment or pier; supporting the ends of the beam within a respective receiving assemblies of the carriages; moving the carriages transversely or laterally across their respective abutment or pier to carry the beam to a final position; and lowering the ends of the beam to deposit the beam at a final position on the supporting structures. The method may further include the step of repositioning the carriages to receive and deposit a second or further beam after a first beam is deposited in position, the step of repositioning being repeated one or more times to deposit in position plural beams forming a road surface support structure of a bridge.

A bridge as described herein may be a specialized span supporting a vehicular way other than a highway, such as a framework for rail carriage (for example, a municipal rail transit line, or an industrial rail line between a mineral extraction site and a processing facility), or may include a structural support for cable-based transport or haulage system. A bridge as contemplated herein may also be designed and engineered to support a structure or object, such as a span of a petroleum, petrochemical, water or natural gas pipeline that extends across a river, a valley or chasm, or a geological fault line. In these cases, the steel or other pipe structure may be cradled on or supported by special supports resting on or attached to the bridge, or the pipe itself may be integrated with steel or structural elements of the bridge and/or may include concrete portions engineered to impart strength, rigidity or other mechanical characteristic. To the extent applicable to the construction of such non-highway pipeline bridges, the term "beam" as used herein will then be understood to also apply to the pipe or conduit, and the term "roadway" will be understood to apply to the pipeline supporting span. It is understood that construction of the pipeline may involve, not simply resting the pipeline on a support, but welding or otherwise sealing the pipe end to the existing or already-placed pipeline. The placement methods and carriage assemblies of the present invention are adapted to provide exact and simple positioning for each end of the pipe or support beams of the span, and thus to enable proper alignment, fitting and construction of pipe junctions. For such a pipeline, the terms "pier" or "abutment" in the discussion herein may include the supports, junction boxes, pumping or heating stations or other pertinent ancillary structures constructed to attach to and/or support ends of the pipe span, and the carriage assemblies described herein may be fitted or adapted to run upon ledges, steps, rails or other support or alignment surfaces of such junction boxes, pumping or heating stations or ancillary pipeline structures.

Advantageously, steps of placing the beam end in a carriage and placing the carriage on an abutment or other supporting structure are accomplished using smaller load-handling equipment and without requiring a tall crane, so that bridge construction is effected expeditiously and cost effectively without having to relocate utility lines, obtain special permitting or coordinate with utilities and special equipment suppliers.

BRIEF DESCRIPTION OF THE DRAWINGS

These and other features of the invention will be understood from the description herein and claims appended hereto, together with the drawings showing an illustrative embodiment of the invention, wherein:

DETAILED DESCRIPTION

In accordance with one aspect of the present invention, a large beam spanning between two opposed supports, such as piers or abutments, is placed in position by a load-bearing carriage that moves across the top of a support. Multiple beams, such as bridge beams to support a roadway, are so placed without the use of long-radius high load capacity crane equipment customarily employed to position heavy beams.

Figure 1:
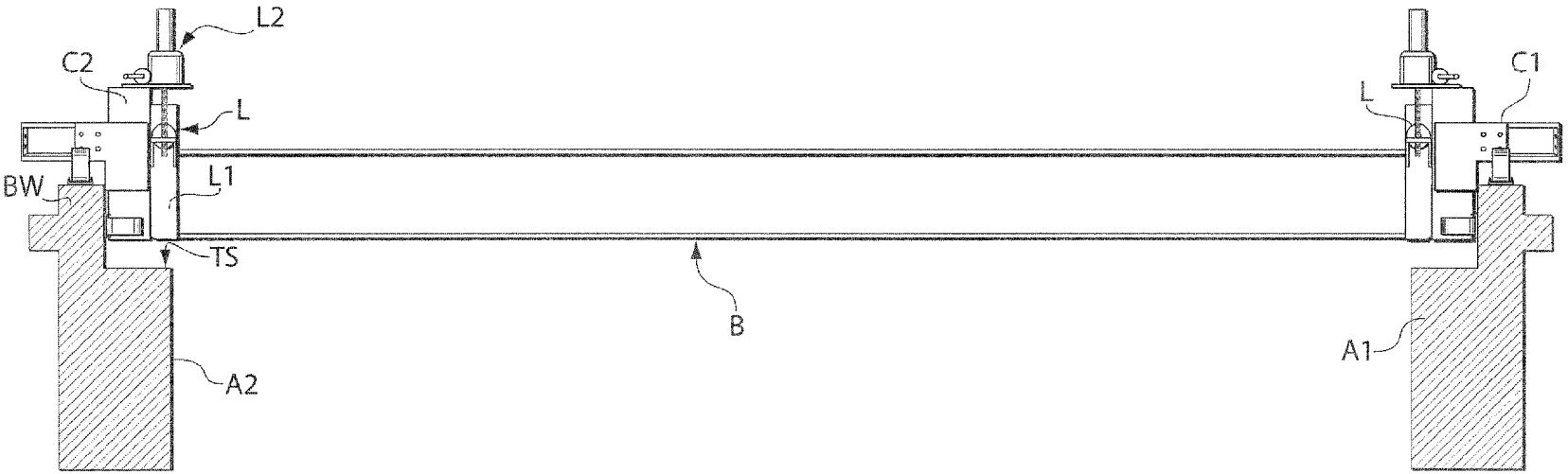
FIG. 1 shows a bridge beam in side view carried by two carriages in accordance with one aspect of the invention.

FIG. 1 shows a bridge beam B in side view carried by two carriages C1 and C2 in accordance with one aspect of the present invention. Illustratively, the beam B is a steel girder, such as an I-beam and appears generally rectangular in side view. However, the beam may alternatively be a box beam or a reinforced concrete beam or other bridge beam. As illustrated, each carriage C1, C2 rests atop a massive concrete support structure, shown as an abutment A1 or A2. As best seen in the perspective view of FIG. 2, each carriage is adapted to travel transversely across a top surface of its respective abutment to carry the beam by its ends to a desired position on the abutment. Each abutment has a backwall BW that extends upward to grade level, and a top support surface TS extending horizontally at a lower level on which the structural bridge beams are to be positioned.

As also shown in the side view of FIG. 1, each carriage C is saddled by or carries a lift, or lift basket assembly L into which an end of the beam. B is fitted. The lift assemblies L support the beam ends at a level sufficiently elevated above the flat table-like surface TS of the abutment to avoid bridge seats and protruding anchor bolts as the carriage moves, until the beam is ultimately lowered in position. A steel bearing plate (not shown) may be affixed to or incorporated in the surface TS to bear the weight of the beam and accommodate slight movement due to thermal expansion.

The lift basket assembly L includes a first, beam-holding portion or assembly L1 and a second beam-lifting or jack portion L2 for moving the portion L1 vertically. Jack assembly L2 may, for example, be a screw jack (operated, e.g., by a hand crank), an hydraulic cylinder jack, or a cam-type jack. Actuating the jack assembly to raise or lower the basket L raises or lowers the end of the beam. The lift basket may be a generally cradle-like structure carried by the carriage, or may, for example, be constituted by two opposed separately-operated lift plates connected by a hinged cross-bar or otherwise configured to form a cradle. Alternatively the lift structure may be implemented by a structure such as a pair of opposed jaws or spaced-apart jack-arms for holding and lifting or supporting the end of the beam above the pier surface. The holding structure is configured such that it may be disengaged and removed from the beam once the beam has been lowered in position on the foundation. Alternatively, or in addition, the carriage may itself be configured to disengage from the emplaced beam. In either case, when disengaged, the carriage may be rolled back or otherwise returned to the point of beginning to receive another beam.

Figure 2:
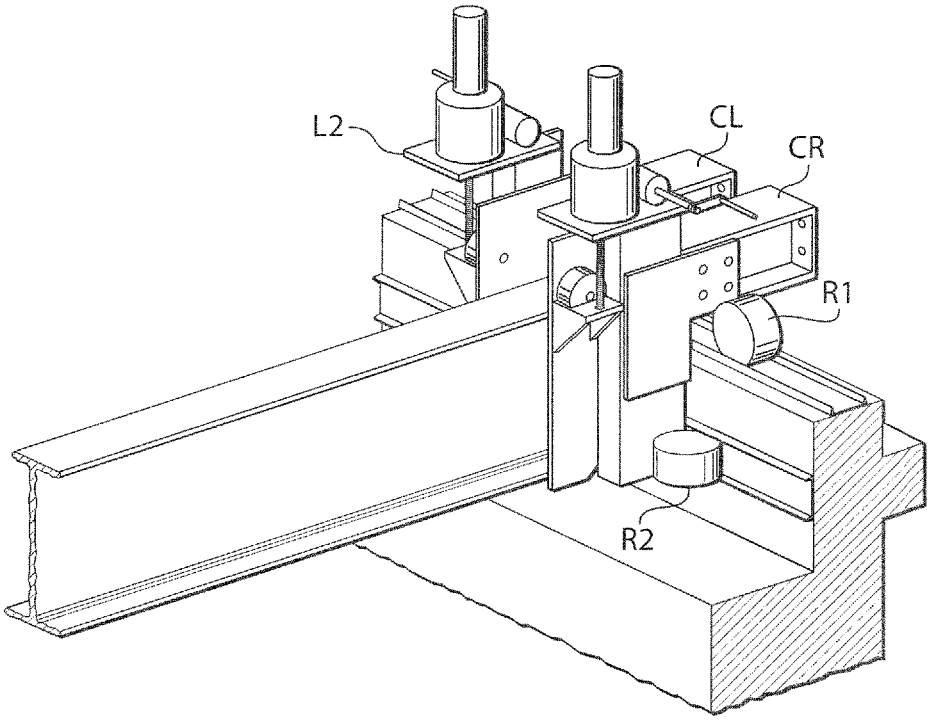
FIG. 2 is a detailed perspective view, partially schematic, of a carriage assembly.
Figure 3:
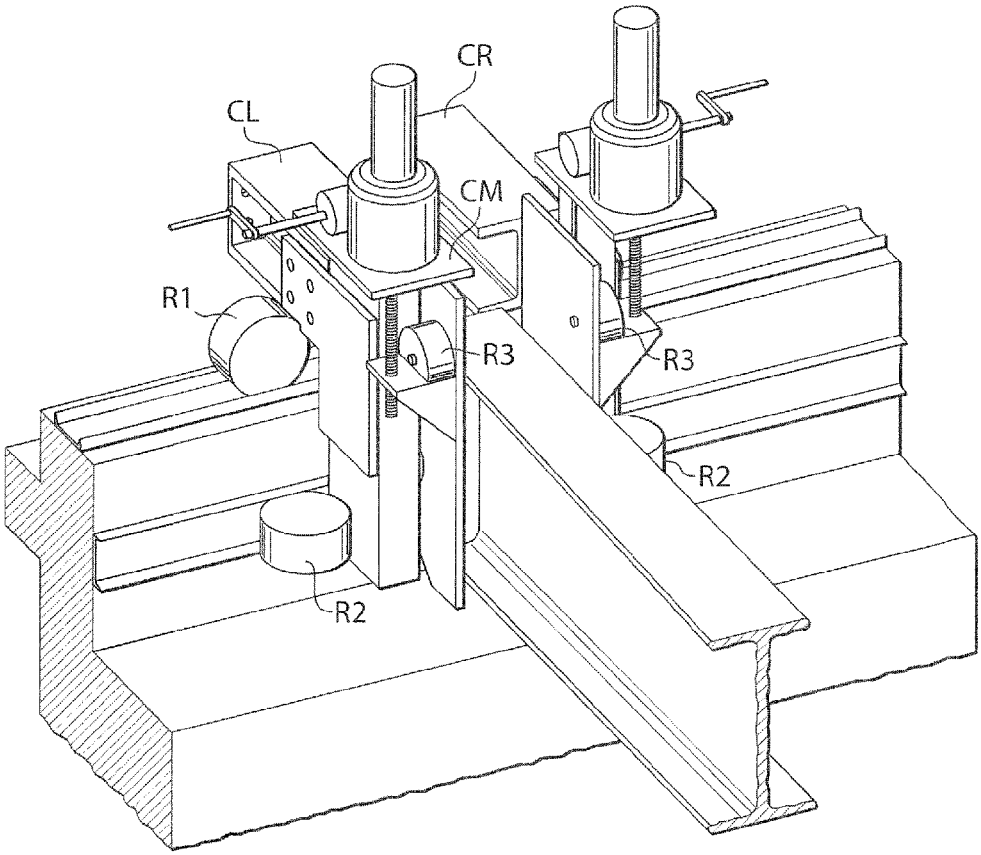
FIG. 3 is a larger detailed perspective view similar to FIG. 2 but from a symmetrically opposite position.

FIGS. 2 and 3 are perspective views, partly schematic, from above and to either side, of one carriage assembly C in accordance with the present invention positioned on an abutment illustrated in FIG. 1. As shown, the carriage assembly comprises left- and right- generally L-shaped body members $C_R$ and $C_L$ that are rigidly joined by and spaced apart by a middle body $C_M$ thus forming a central channel that accommodates the beam B and the beam-lifting assembly, basket L. The L-shaped members are inverted (i.e., upside-down Ls) and carry respective sets of rollers on their horizontal and vertical arms, bearing against the top surface (rollers $R_1$) or the vertical face of the backwall (rollers $R_2$). The central portion of the carriage body $C_M$ does not extend entirely over the beam support surface TS, so the cleft between left and right sides of the carriage is open in that region. However the central channel or cleft is extended by the lift plates L1, which fit between the sides $C_R$ and $C_L$ and extend over the support surface TS, thus forming a positioning/lifting assembly axially offset from the carriage along the beam axis. The lift jacks L2 are secured to the top of the carriage arms, so that the carriage bears the full weight of the lift assemblies L and the beam carried therein by the lift plates, jaws or basket formed by the plates L1.

As shown schematically in FIG. 3, the carriage moves upon a first set of rollers $R_1$, such as Hilman® rollers or other heavy equipment rollers connected to the horizontal arms of the L-shaped carriage body members and situated to bear the vertical load of the carriage, and a second set of rollers $R_2$ carried by the vertical arms of the L-shaped carriage body. A third set of rollers $R_3$ are mounted for rolling movement of the lift assembly L against a vertical face of the carriage body as the lift assembly is raised or lowered.

In one method of use, a bridge beam B may be off-loaded from a truck or rail car by a construction lift operating at or near ground level to place the beam axially extending through the carriage channel. The beam may then be fed through the channel (e.g., on rollers or with a special pusher vehicle), while the far end is preferably suspended or supported using a small crane or lift to prevent excessive tipping until the far end enters the channel of a similar carriage placed on the opposite foundation structure. Advantageously, the small crane or lift bears only a portion of the weight of the beam, obviating the need for massive equipment. Each carriage is then moved transversely across its respective foundation structure (e.g., two abutments, two piers, or an abutment and a pier) to position the beam ends at precise locations as described above. Loading the beam into the carriage(s) and moving the carriages transversely thus positions the ends of the beam on its bridge seats or load plates on the cement foundation structures dependably and safely without requiring a large heavy-load crane. The necessary carriage assembly is basically a dolly or skate with rollers set to bear against in two orthogonal planes and defining a beam-receiving channel in which the lifting assembly serves to align and vertically support the beam as the carriage moves the beam to the desired location.

Figure 4:
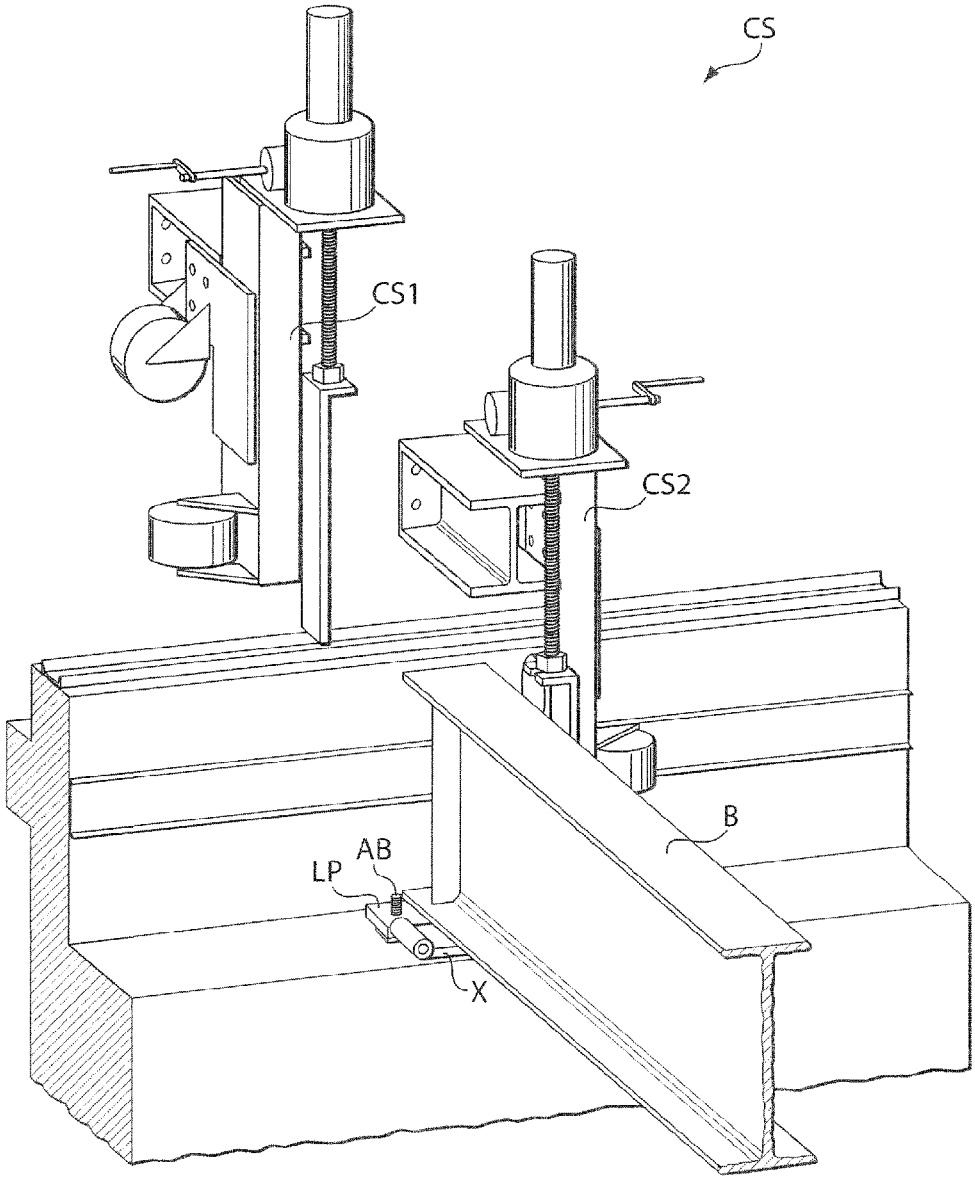
FIG. 4 is a perspective view of a separable two-part carriage.

FIG. 4 shows another embodiment CS of a carriage assembly useful for the present invention. In this embodiment the carriage assembly is comprised of two body half-sections CS1 and CS2 that are approximately mirror images and that can be separated after use for convenient removal from the beam. In use, both sections are bolted or otherwise fastened together to form a carriage as described above, with one section lying on each side of the beam B. For clarity of illustration the beam B is shown positioned mid-way across the abutment in this figure. FIG. 4 shows the sections separated from each other after the beam B has been positioned on the foundation on its load plate LP between protruding anchor bolts AB. With section CS1 thus separated from section CS2, the solid cross-member X joining the two lift assemblies may slide freely under the seated beam, allowing carriage section CS2 to return to its position of origin at the right side of the foundation, and allowing the remaining carriage section CS1 to be lifted up above the beam (manually, or using a lift or cherry-picker) and moved into a position for reattachment to the section CS2 to receive and transport a second beam.

A bridge as described herein need not be a roadway bridge; it may be specialized for supporting a vehicular way other than a highway, such as a framework for rail carriage (for example, a municipal rail transit line, or an industrial rail line between a mineral extraction site and a processing facility), or may include a structural support for cable-based transport or haulage system. A bridge as contemplated herein may also be designed and engineered to support a structure or object, such as a span of a petroleum, petrochemical, water or natural gas pipeline that extends across a river, a valley or chasm, or a geological fault line. In these cases, the steel or other pipe structure may be cradled on or supported by special supports resting on or attached to the bridge, or the pipe itself may be integrated with steel or structural elements of the bridge and/or may include concrete portions engineered to impart strength, rigidity or other mechanical characteristic. To the extent applicable to the construction of such non-highway pipeline bridges, the term "beam" as used herein will then be understood to also apply to the pipe or conduit, and the term "roadway" will be understood to apply to the pipeline supporting span. It is understood that construction of the pipeline may involve, not simply resting the pipeline on a support, but welding or otherwise sealing the pipe end to the existing or already-placed pipeline. The placement methods and carriage assemblies of the present invention are adapted to provide exact and simple positioning for each end of the pipe or support beams of the span, and thus to enable proper alignment, fitting and construction of pipe junctions. For such a pipeline, the terms "pier" or "abutment" in the discussion herein may include the supports, junction boxes, pumping or heating stations or other pertinent ancillary structures constructed to attach to and/or support ends of the pipe span, and the carriage assemblies described herein may be fitted or adapted to run upon ledges, steps, rails or other support or alignment surfaces of such junction boxes, pumping or heating stations or ancillary pipeline structures.

The foregoing description sets forth several basic embodiments and describes structure and function of several aspects of the invention, but is illustrative and not exhaustive. Thus, for example, rather than simple rollers, the carriage may be a powered carriage, may include a rack-and-gear sliding drive assembly, or may include gearing and a hand or other motive-powered mechanism for moving the rollers. The jack assembly may be implemented by one or more hydraulic cylinders incorporated in the body of the carriage, and the lift assembly may take various forms other than the simple plate and angle bracket construction that is illustrated for schematic purposes in FIGS. 1-3 or the hinged cross bar of FIG. 4. The invention being thus disclosed and described, other features and embodiments will occur to those skilled in the art and are considered to be within the spirit and scope of the invention defined by this specification and the claims appended hereto.

What is claimed is:

1. A device for positioning and aligning a beam upon a seat on a support which is an abutment or pier during construction of a bridge, wherein the beam has a longitudinal axis, wherein the device comprises a carriage under the beam and a lift assembly configured to removably receive and support an end of the beam, wherein the carriage is configured for movement along the top of the support in a direction transverse to the longitudinal axis of the beam wherein the lift assembly is carried by the carriage and forms a u-shaped receptacle for receiving and supporting the end of the beam above a seat as the carriage moves along said transverse direction, the lift assembly being operable to move the beam vertically with respect to the carriage and seat, so that when an end of the beam is positioned in the receptacle on the carriage, movement of the carriage transversely positions the beam in a desired final position, and vertical lowering of the lift-assembly deposits the beam upon the seat on the support at said desired final position.

2. The device of claim 1, wherein the lift assembly is movable vertically by a jack assembly.

3. The device of claim 2, wherein the jack assembly includes a hydraulic jack assembly or a screw-jack assembly which may be operated by motor or hand crank, to raise or lower the beam.

4. The device of claim 2, wherein the lift assembly comprises opposed separately-operated lift plates which form said u-shaped receptacle.

5. The device of claim 1, wherein the carriage comprises rollers positioned to roll along a track or channel affixed to the top of the support thereby defining a carriage path of transverse linear movement for positioning and aligning the end of the beam on the seat.

6. The device of claim 5, wherein said rollers include a first set of rollers bearing against a load-bearing horizontal top surface of the support, and second set of rollers bearing against a vertical face of the support, operative to maintain orientation or alignment of the carriage and the end of the beam along two or more axes as the carriage moves.

7. The device of claim 1, wherein the device is positionable on the support to deposit the beam in a desired position and is removable from the support with the beam in position.

8. The device of claim 7, wherein the lift assembly is disengageable from the beam and/or removable from the carriage to permit re-positioning of the carriage for moving an adjacent beam when the beam has been deposited in a desired position.

9. The device of claim 7, wherein the carriage comprises a first and a second body portion, wherein the body portions are connected to each other in a first configuration for constituting the carriage for supporting and moving the beam transversely to a desired position, and the body portions are separable from each other in a second configuration for re-positioning the carriage to receive and transport a further beam across the support.

10. The device of claim 6, wherein the carriage includes means for adjusting offset of one or more rollers for adjusting beam position along one or more axes.

11. The device of claim 1, wherein the bridge carries a span of pipeline and the carriage positions an end of a pipe in the span.

12. The device of claim 1, wherein the bridge is a structure supporting a rail structure, a cable transit or haulage structure or a pipeline structure.

13. A system for positioning a beam between two supporting abutments or piers, such system comprising a pair of devices according to claim 1, each being positioned on a respective one of the supporting structures and including a lift assembly such as a yoke, basket or pair of support jaws, such that the lift assembly of each device receives and supports an end of the beam during carriage movement to enable lateral or transverse movement of and positioning of the ends of the beam to desired positions on the respective supporting structures.

14. A method for positioning a beam for a bridge onto a pair of supporting structures, the method comprising:

positioning each of a pair of carriage devices on a respective abutment or pier, wherein the carriages are configured to move along respective paths or along tracks fastened to an abutment or pier, each carriage being adapted to support an end of the beam under the beam within a receiving channel centrally in the carriage;

rolling each carriage device along the path or tracks transversely across the respective abutment or pier to the final position; and, lowering each end of the beam to precisely seat the beam at desired positions on the respective abutment or pier.

15. The method of claim 14, further comprising the steps of repositioning the carriages to receive and deposit a second or further beam after a first beam is deposited in position, the step of repositioning being repeated one or more times to deposit in position plural beams forming a road surface support framework of a bridge.

16. The method of claim 15, further comprising the step of separating a carriage into two portions to allow the carriage to be moved away from the deposited beam and repositioned.

17. A method of precisely positioning and depositing a beam across opposed supporting structures during construction of a bridge, such method comprising the steps of providing a carriage on the top of each supporting structure adapted to support an end of the beam under the beam, as the carriage moves in a transverse path across the supporting structure and adapted to lower the beam onto the supporting structure when the carriage reaches a desired position, thereby controllably and precisely moving the beam to a final position, wherein placement of the beam ends in the carriage and placement of the carriage on the supporting structure are accomplished using construction site lifting or moving machines other than a tall or high load crane, thereby enabling bridge construction to be effected more quickly and cost effectively.

18. The method of claim 17, including the step of placing the beam axially into a centrally-extending channel in each carriage, the channel being configured to support the beam during movement and to lower the beam onto a seat when moved to a desired position.

19. The method of claim 17, wherein the bridge carries a span of pipeline and the carriage positions an end of a pipe in the span.

20. The method of claim 17, wherein the bridge is a structure supporting a rail structure, a cable transit or haulage structure or a pipeline structure.

* * * * *